US012050082B1

(12) United States Patent
Bray

(10) Patent No.: US 12,050,082 B1
(45) Date of Patent: Jul. 30, 2024

(54) ACCESSORY MOUNTING INTERFACE

(71) Applicant: Polaris Capital Corporation, Orem, UT (US)

(72) Inventor: Ernest R. Bray, American Fork, UT (US)

(73) Assignee: Polaris Capital Corporation, Orem, UT (US)

( * ) Notice: Subject to any disclaimer, the term of this patent is extended or adjusted under 35 U.S.C. 154(b) by 0 days.

(21) Appl. No.: 18/464,593

(22) Filed: Sep. 11, 2023

(51) Int. Cl.

| | |
|---|---|
| ***F41G 11/00*** | (2006.01) |
| ***F41A 23/08*** | (2006.01) |
| ***F41C 23/02*** | (2006.01) |
| ***F41C 23/16*** | (2006.01) |

(52) U.S. Cl.
CPC ..... *F41G 11/003* (2013.01); *F41C 23/16* (2013.01); *F41A 23/08* (2013.01); *F41C 23/02* (2013.01)

(58) Field of Classification Search
CPC ..... F41G 11/003; F41C 23/16; F41C 23/02; F41A 23/08
See application file for complete search history.

(56) References Cited

U.S. PATENT DOCUMENTS

| | | | | |
|---|---|---|---|---|
| 7,814,698 | B2 * | 10/2010 | Fluhr | F41G 1/26 42/111 |
| 8,393,105 | B1 | 3/2013 | Thummel | |
| 9,341,441 | B2 | 5/2016 | Cheng et al. | |
| 9,921,029 | B2 | 3/2018 | Roberts et al. | |
| 10,101,126 | B2 * | 10/2018 | Sharron | F41G 11/003 |
| 10,240,901 | B1 * | 3/2019 | Cheng | F41A 35/00 |
| 10,260,841 | B2 | 4/2019 | Kincel et al. | |
| 10,288,376 | B2 * | 5/2019 | Gottzmann | F41G 11/003 |
| 10,473,432 | B2 | 11/2019 | Jen | |
| 10,557,681 | B2 * | 2/2020 | Cahill | F41C 27/00 |
| 10,724,569 | B2 | 7/2020 | Windfeldt et al. | |
| 11,029,131 | B2 * | 6/2021 | Cahill | F41G 11/003 |
| 11,536,535 | B2 | 12/2022 | Mayberry et al. | |
| 11,752,596 | B2 * | 9/2023 | Stabler | F41G 11/003 248/229.16 |
| 11,839,959 | B2 * | 12/2023 | Stabler | F16B 2/185 |
| 2015/0362291 | A1 | 12/2015 | Samson et al. | |
| 2016/0209175 | A1 * | 7/2016 | Sharron | F41G 11/003 |
| 2020/0208946 | A1 * | 7/2020 | Cahill | F41G 11/001 |
| 2023/0272811 | A1 * | 8/2023 | Stabler | F16B 2/185 248/205.1 |

* cited by examiner

*Primary Examiner* — Michelle Clement
(74) *Attorney, Agent, or Firm* — Kunzler Bean & Adamson

(57) ABSTRACT

Examples of the present disclosure include a mounting interface with a body and a cam coupled to the body and rotatable about an axis. The mounting interface includes a first locking mechanism in contact with a first arm of the cam and configured to, in response to rotation of the cam in a first rotational direction, move in a first lateral direction and engage with a first end of a first opening of a handguard of a gun. The mounting interface includes a second locking mechanism configured to, in response to rotation of the cam in the first rotational direction, move in a second lateral direction opposite the first lateral direction and engage with at least one of a second end of the first opening opposite to the first end of the opening and an end of a second opening of the handguard.

17 Claims, 13 Drawing Sheets

ACCESSORY MOUNTING INTERFACE

FIELD

This disclosure relates generally to systems, methods and apparatuses for mounting accessories to guns and more particularly to systems and apparatuses for handguard mounting interfaces.

BACKGROUND

Gun handguards are attached to a gun and protect a user's hands from heat and recoil of a gun. Mounting rails can be attached to handguards and serve as an interface to attach accessories, such as lasers, to handguards.

SUMMARY

The subject matter of the present application has been developed in response to the present state of the art, and in particular, in response to the shortcomings of mounting interface systems and apparatuses that have not yet been fully solved by currently available techniques. Accordingly, the subject matter of the present application has been developed to provide mounting interface systems and apparatuses that overcome at least some of the above-discussed shortcomings of prior art techniques.

The following is a non-exhaustive list of examples, which may or may not be claimed, of the subject matter, disclosed herein.

Examples of the present disclosure include a mounting interface. A mounting interface includes a body and a cam coupled to the body and rotatable about an axis. The mounting interface includes a first locking mechanism positioned in contact with a first arm of the cam and configured to, in response to rotation of the cam in a first rotational direction, move in a first lateral direction towards a first end of the body engage with a first end of a first opening of a handguard or mounting surface of a gun. The mounting interface includes a second locking mechanism positioned in contact with a second arm of the cam and configured to, in response to rotation of the cam in the first rotational direction move in a second lateral direction opposite the first direction and towards a second end of the body opposite the first end and engage with at least one of a second end of the first opening opposite to the first end of the opening and an end of a second opening of the handguard.

Examples of the present disclosure include a system. The system includes a body and an accessory coupled to a first side of the body. The system includes a cam coupled to a second side of the body opposite to the first side of the body and rotatable about an axis. The system includes a first locking mechanism positioned in contact with a first arm of the cam and configured to, in response to rotation of the cam in a first rotational direction, move in a first lateral direction towards a first end of the body and engage with a first end a first opening of a handguard of a gun. The system includes a second locking mechanism positioned in contact with a second arm of the cam and configured to, in response to rotation of the cam in the first rotational direction, move in a second lateral direction opposite the first direction and towards a second end of the body opposite the first end and engage with at least one of an end of a second opening of the handguard and a second end of the first opening opposite to the first end of the first opening.

Examples of the present disclosure include a mounting interface. The mounting interface includes a body and a pinion gear coupled to the body and rotatable about an axis. The mounting interface includes a first rack gear positioned to engage with the pinion gear and configured to, in response to rotation of the pinion gear, move laterally in a first direction towards a first end of the body. The mounting interface includes a first locking mechanism coupled to the first rack gear and configured to engage with a first end of a first opening of a handguard of a gun. The mounting interface includes a second rack gear positioned to engage with the pinion gear and configured to, in response to rotation of the pinion gear, move laterally in a second direction opposite the first direction and towards a second end of the body opposite the first end. The mounting interface includes a second locking mechanism coupled to the second rack gear and configured to engage with at least one of an end of a second opening of the handguard and a second end of the first opening opposite to the first end of the first opening.

The described features, structures, advantages, and/or characteristics of the subject matter of the present disclosure may be combined in any suitable manner in one or more examples and/or implementations. In the following description, numerous specific details are provided to impart a thorough understanding of examples of the subject matter of the present disclosure. One skilled in the relevant art will recognize that the subject matter of the present disclosure may be practiced without one or more of the specific features, details, components, materials, and/or methods of a particular example or implementation. In other instances, additional features and advantages may be recognized in certain examples and/or implementations that may not be present in all examples or implementations. Further, in some instances, well-known structures, materials, or operations are not shown or described in detail to avoid obscuring aspects of the subject matter of the present disclosure. The features and advantages of the subject matter of the present disclosure will become more fully apparent from the following description and appended claims, or may be learned by the practice of the subject matter as set forth hereinafter.

BRIEF DESCRIPTION OF THE DRAWINGS

In order that the advantages of the subject matter may be more readily understood, a more particular description of the subject matter briefly described above will be rendered by reference to specific examples that are illustrated in the appended drawings. Understanding that these drawings, which are not necessarily drawn to scale, depict only certain examples of the subject matter and are not therefore to be considered to be limiting of its scope, the subject matter will be described and explained with additional specificity and detail through the use of the drawings, in which.

DETAILED DESCRIPTION

Figure 1A:
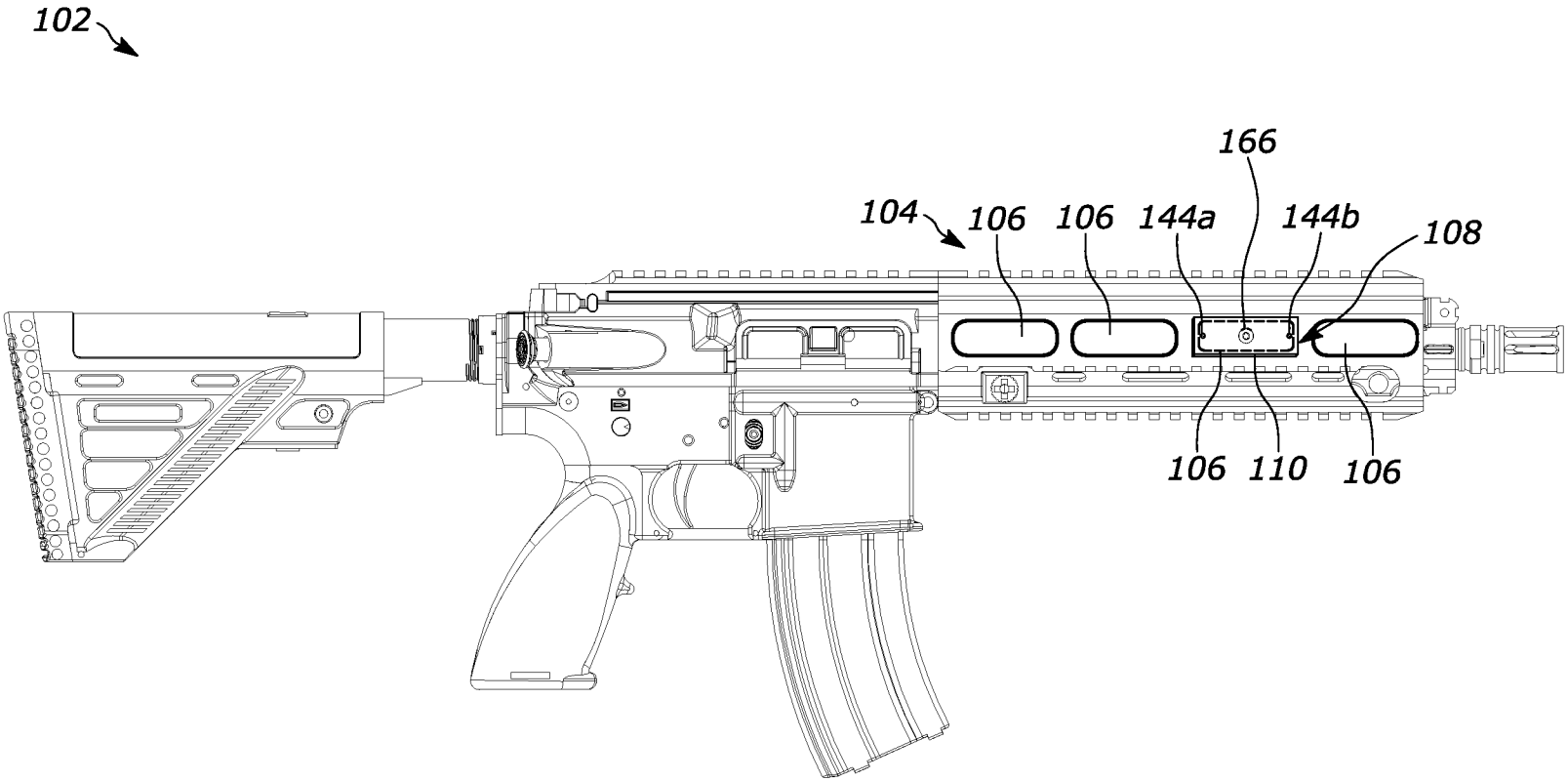
FIG. 1A shows a gun with a rail and a mounting interface mounted to the rail, according to one or more examples of the present disclosure.

Reference throughout this specification to "one example," "an example," or similar language means that a particular feature, structure, or characteristic described in connection with the example is included in at least one example of the present disclosure. Appearances of the phrases "in one example," "in an example," and similar language throughout this specification may, but do not necessarily, all refer to the same example. Similarly, the use of the term "implementation" means an implementation having a particular feature, structure, or characteristic described in connection with one or more examples of the present disclosure, however, absent an express correlation to indicate otherwise, an implementation may be associated with one or more examples.

The following portion of this paragraph delineates example 1 of the subject matter, disclosed herein. According to example 1, a mounting interface includes a body and a cam coupled to the body and rotatable about an axis. The mounting interface includes a first locking mechanism positioned in contact with a first arm of the cam and configured to, in response to rotation of the cam in a first rotational direction, move in a first lateral direction towards a first end of the body engage with a first end of a first opening of a handguard of a gun. The mounting interface includes a second locking mechanism positioned in contact with a second arm of the cam and configured to, in response to rotation of the cam in the first rotational direction move in a second lateral direction opposite the first direction and towards a second end of the body opposite the first end and engage with at least one of a second end of the first opening opposite to the first end of the opening and an end of a second opening of the handguard.

The following portion of this paragraph delineates example 2 of the subject matter, disclosed herein. According to example 2, which encompasses example 1, above, the body includes a first side including an opening and a second side coupled to the cam and to the at least two locking mechanisms. The opening at least partially overlaps the cam.

The following portion of this paragraph delineates example 3 of the subject matter, disclosed herein. According to example 3, which encompasses example 1 or 2, above, the cam is coupled to a component having a slot accessible through the opening and configured to receive a head of a tool to cause rotation of the cam in response to rotation of the tool.

The following portion of this paragraph delineates example 4 of the subject matter, disclosed herein. According to example 4, which encompasses any one of examples 1-3, above, each of the first locking mechanism and second locking mechanism having a peg configured to receive an end of a spring.

The following portion of this paragraph delineates example 5 of the subject matter, disclosed herein. According to example 5, which encompasses any one of examples 1-4 above, the body includes at least two body openings. Each of the first locking mechanism and the second locking mechanism includes a socket.

The following portion of this paragraph delineates example 6 of the subject matter, disclosed herein. According to example 6, which encompasses any one of examples 1-5 above, at least one of the at least two body openings is configured to receive a screw simultaneously with the socket.

The following portion of this paragraph delineates example 7 of the subject matter, disclosed herein. According to example 7, which encompasses any one of examples 1-6 above, each of the first direction and the second direction is substantially perpendicular to the axis.

The following portion of this paragraph delineates example 8 of the subject matter, disclosed herein. According to example 8, which encompasses any one of examples 1-7 above, the first locking mechanism is configured to, in response to rotation of the cam in a second rotational direction opposite to the first rotational direction, move from the first end of the body in the second lateral direction towards the axis. The second locking mechanism is configured to, in response to rotation of the cam in the second rotational direction, move from the second end of the body in the first lateral direction towards the axis.

The following portion of this paragraph delineates example 9 of the subject matter, disclosed herein. According to example 9, which encompasses any one of examples 1-8 above, at least one of the first locking mechanism and the second locking mechanism includes a slot configured to receive at least one of the first end of the first opening, the second end of the first opening, or the end of the second opening.

The following portion of this paragraph delineates example 9 of the subject matter, disclosed herein. According to example 10, which encompasses any one of examples 1-9 above, the slot has a first height at a first slot end and a second height at a second slot end opposite to the first slot end. The first height is greater than the second height. A distance between the first slot end and the cam is greater than a distance between the second slot end and the cam.

The following portion of this paragraph delineates example 10 of the subject matter, disclosed herein. According to example 11, which encompasses any one of examples 1-10 above, the mounting interface includes at least one lever coupled to and extending outward from the cam. A distance between the axis and an end of the at least one lever is greater than a distance between the axis and an edge of the body and the cam is rotatable via the lever.

The following portion of this paragraph delineates example 12 of the subject matter disclosed herein. According to example 12, a system includes a body and an accessory coupled to a first side of the body. The system includes a cam coupled to a second side of the body opposite to the first side of the body and rotatable about an axis. The system includes a first locking mechanism positioned in contact with a first arm of the cam and configured to, in response to rotation of the cam in a first rotational direction, move in a first lateral direction towards a first end of the body and engage with a first end a first opening of a handguard of a gun. The system includes a second locking mechanism positioned in contact with a second arm of the cam and configured to, in response to rotation of the cam in the first rotational direction, move in a second lateral direction opposite the first direction and towards a second end of the body opposite the first end and engage with at least one of an end of a second opening of the handguard and a second end of the first opening opposite to the first end of the first opening.

The following portion of this paragraph delineates example 13 of the subject matter disclosed herein. According to example 13, which includes example 12 above, the accessory includes at least one of: a sight, a light, a laser, a foregrip, a bipod, a sling mount, a rail cover, and/or any combination thereof.

The following portion of this paragraph delineates example 14 of the subject matter disclosed herein. According to example 14, which includes any of examples 12-13 above, the system includes at least one lever coupled to and extending outward from the cam. A distance between the axis and an end of the at least one lever is greater than a distance between the axis and an edge of the body. The cam is rotatable via the lever while the accessory is coupled to the first side.

The following portion of this paragraph delineates example 15 of the subject matter disclosed herein. According to example 15, which includes any of examples 12-14 above, the body includes at least one of a modular lock rail or a picatinny rail.

The following portion of this paragraph delineates example 16 of the subject matter disclosed herein. According to example 16, which includes any of examples 12-15 above, the first arm includes a curved edge and at least two substantially straight edges.

The following portion of this paragraph delineates example 17 of the subject matter disclosed herein. According to example 17, which includes any of examples 12-16 above, the first locking mechanism is configured to move along the curved edge while moving in the first lateral direction.

The following paragraph delineates example 18 of the subject matter disclosed herein. Examples of the present disclosure include a mounting interface. The mounting interface includes a body and a pinion gear coupled to the body and rotatable about an axis. The mounting interface includes a first rack gear positioned to engage with the pinion gear and configured to, in response to rotation of the pinion gear, move laterally in a first direction towards a first end of the body. The mounting interface includes a first locking mechanism coupled to the first rack gear and configured to engage with a first end of a first opening of a handguard of a gun. The mounting interface includes a second rack gear positioned to engage with the pinion gear and configured to, in response to rotation of the pinion gear, move laterally in a second direction opposite the first direction and towards a second end of the body opposite the first end. The mounting interface includes a second locking mechanism coupled to the second rack gear and configured to engage with at least one of an end of a second opening of the handguard and a second end of the first opening opposite to the first end of the first opening.

The following paragraph delineates example 19 of the subject matter disclosed herein. According to example 19, which includes example 18 above, the body includes a first side. The first side includes a recess wherein the pinion gear, the first rack gear, and the second rack gear are positioned within the recess.

The following paragraph delineates example 20 of the subject matter disclosed herein. According to example 20, which includes any of examples 18-19 above, the body further includes a second side opposite to the first side. The second side includes an opening that at least partially overlaps the pinion gear. The pinion gear includes a slot accessible through the opening and shaped to receive a head of a tool to cause rotation of the pinion gear in response to rotation of the tool.

FIG. 1A shows a gun 102 with a handguard 104 and a mounting interface 108 mounted to the handguard 104, according to one or more examples of the present disclosure. In some examples, the gun 102 is a firearm. In other examples, the gun 102 is an air gun.

The handguard 104 fits over a barrel of the gun 102 and can help protect the user's hands. Additionally, the handguard 104, in conjunction with the mounting interface 108, can mount accessories to the gun 102. In some examples, the handguard 104 includes a modular lock handguard, such as an M-Lok® handguard. However, examples of the present disclosure are not so limited. In some examples, the handguard 104 includes a KeyMod™ handguard.

The mounting interface 108 is mounted to the handguard 104 according to any of the examples included herein. In some examples, the mounting interface 108 serves as an interface between the handguard 104 and an accessory (e.g., accessory 112 of FIG. 1C). In other words, the mounting interface 108 mounts an accessory 112 to the gun 102.

Figure 1B:
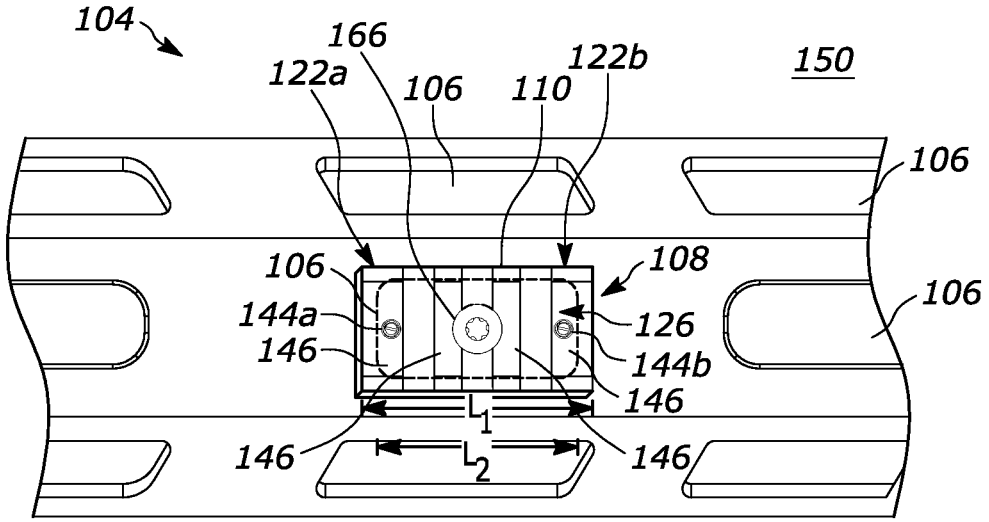
FIG. 1B shows a close-up view of the mounting interface of FIG. 1A.

FIG. 1B shows a close-up view of the mounting interface 108 of FIG. 1A. As shown in FIG. 1A, the mounting interface 108 is secured to at least one opening 106 of the handguard 104. In some examples, the mounting interface 108 attaches to two opposite ends 122*a* and 122*b* of an opening 106 of the handguard 104. As shown in FIG. 1B, in some examples, the ends 122*a* and 122*b* of the opening 106 are opposite ends of the length l2 of the opening.

In some examples, the length l1 of the mounting interface 108 is greater than or equal to the length l2 of the opening 106 across which it spans. In some examples, a shape of the mounting interface 108 corresponds to a shape of the opening 106. For example, as shown in FIG. 1B, both the opening 106 and the mounting interface 108 are substantially rectangular in shape. However, examples of the present disclosure are not so limited.

As shown in FIG. 1B, the mounting interface 108 includes a body 110 having a first side 126 that is visible from the exterior 150 of the handguard 104. As shown in FIGS. 1B, in some examples, a first side 126 of the body 110, or the side 126 facing an exterior 150 of the handguard 104, has a rail-like configuration. For example, the first side 126 includes a number of raised portions 146. In some examples, these raised portions 146 are spaced not less than 0.1 and not greater than 1.1 inches apart. In some examples, the body 110 of the mounting interface 108 includes a picatinny rail. In other examples, the body 110 includes an MLOK® rail.

Figure 1C:
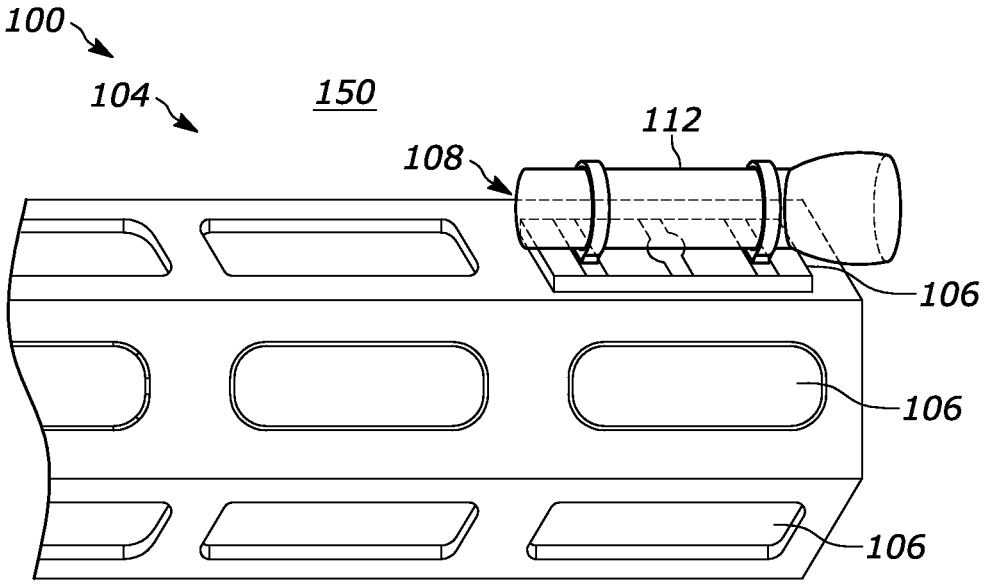
FIG. 1C illustrates a gun with a handguard and a mounting interface and accessory mounted to the rail, according to one or more examples of the present disclosure.

FIG. 1C illustrates a system 100 including the gun 102, the handguard 104, the mounting interface 108, and an accessory 112 mounted to the handguard 104 via the mounting interface 108, according to one or more examples of the present disclosure. As shown in FIG. 1C, the accessory 112 is coupled to the first side 126 of the body 110.

As shown in FIGS. 1B and 1C, in some examples, the first side 126 of the body 110 has a rail-like configuration. However, examples of the present disclosure are not so limited. In some examples, the first side 126 of the mounting interface 108 is a plate system. For example, the first side 126 includes one or more grooves for a plate attached to an accessory to slide into. In other examples, the accessory 112 is formed onto the first side 126. In other examples, the first side 126 includes a plate that is configured to be attached to an accessory for mounting. In some examples, the first side 126 includes a number of slots. The accessory 112 includes a number of holes to positioned over the slots, and a number of screws and/or nuts are used to secure the accessory 112 onto the mounting interface 108. In some examples, the accessory 112 includes a number of tabs that are designed to fit into a number of slots of the mounting interface and are secured to the mounting interface 108 via a number of screws and/or nuts.

As shown in FIG. 1C, in some examples, the accessory 112 includes a light. However, examples of the present disclosure are not so limited. The accessory 112 includes, for example, at least one of: a sight, a light, a laser, a foregrip, a bipod, a bipod adapter, a sling mount, a cover for the handguard 104, a scope, a hand stop, a camera mount, a pressure switch or mount, a rail segment, a rail scale, a night vision device, a thermal imaging device, a light mount, and/or any combination thereof.

Figure 2:
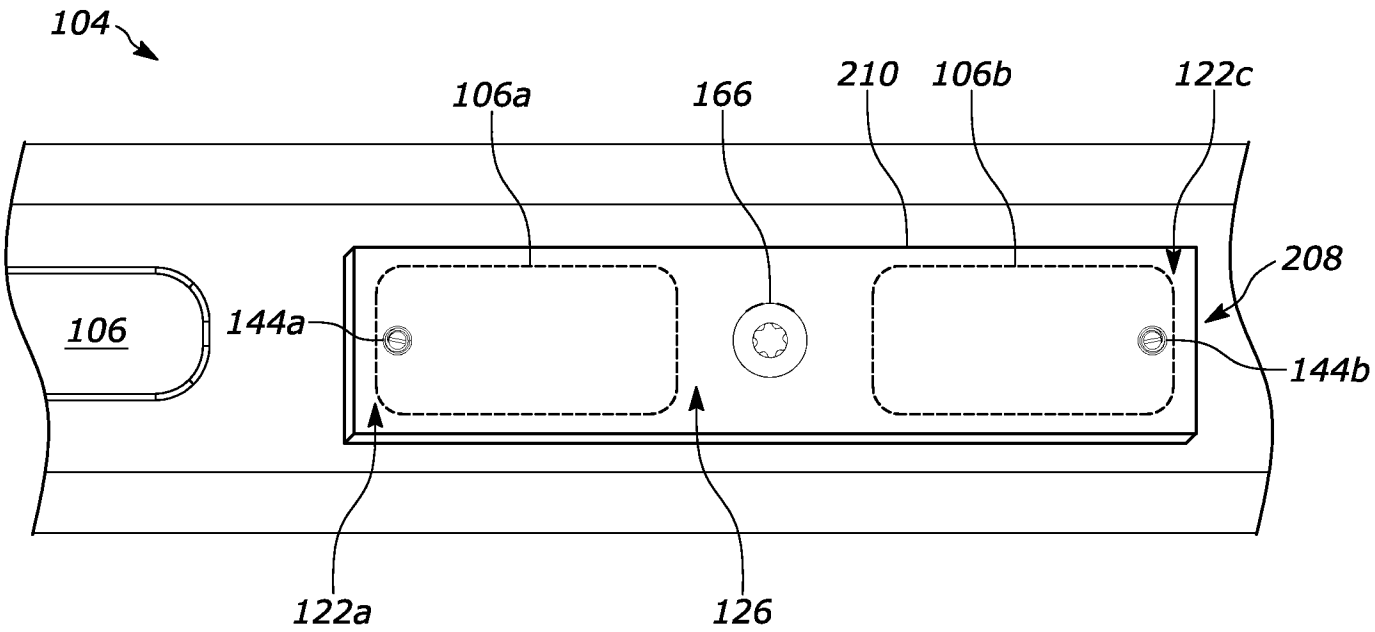
FIG. 2 illustrates a close-up view of a mounting interface spanning two openings of a handguard, according to one or more examples of the present disclosure.

FIG. 2 illustrates a close-up view of a mounting interface 208 spanning two openings of a handguard 104. In some examples, the mounting interface 208 attaches to an end 122*a* of a first opening 106*a* and to an end 122*c* of a second opening 106*b*. For example, the mounting interface 208 attaches to an end 122*c* of the second opening 106*b* that is non-adjacent to the first opening 106*a*. A distance between the ends 122*a* and 122*c* is substantially parallel to the length l1 of the mounting interface 108. In some examples, the mounting interface 208 covers at least two openings 106*a*, 106*b*. In some examples, the mounting interface covers more than two openings 106.

FIGS. 3A-E illustrate various view of a mounting interface 308, according to one or more examples of the present disclosure. The mounting interface 308 is, for example, an example of the mounting interfaces 108 or 208 of FIGS. 1A-2. As shown in FIGS. 3A-E, the mounting interface 308 includes a body 310, a cam 314 coupled to the body 310, a first locking mechanism 318*a*, and a second locking mechanism 318*b*. The first locking mechanism 318*a* and the second locking mechanism 318*b* may be referred to herein, individually or collectively, as "318."

Figure 3A:
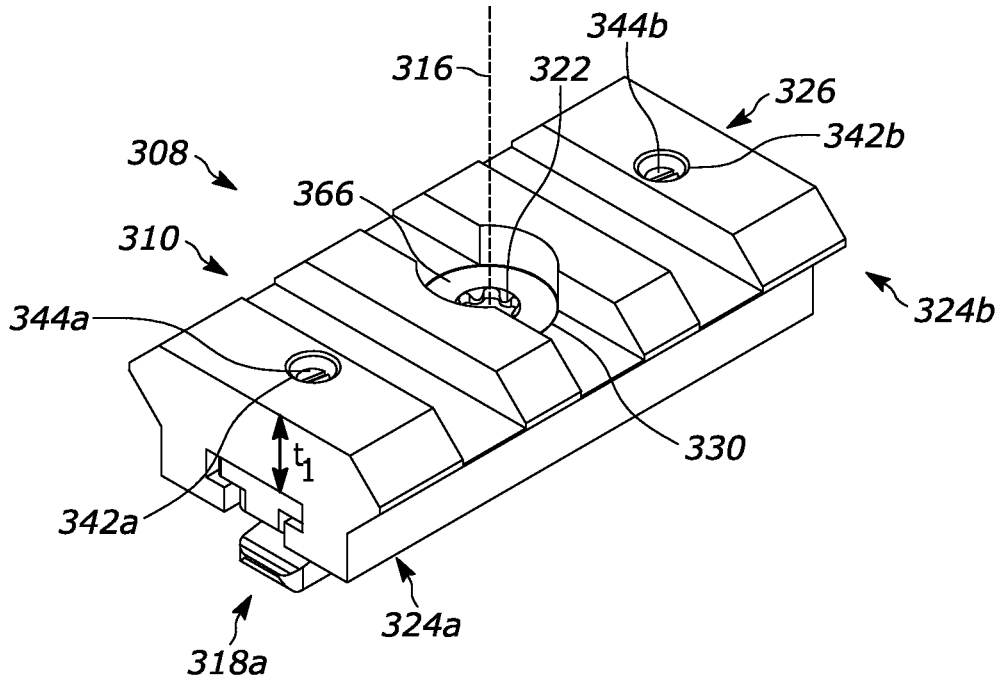
FIG. 3A illustrates a perspective view of a mounting interface, according to one or more examples of the present disclosure.
Figure 3B:
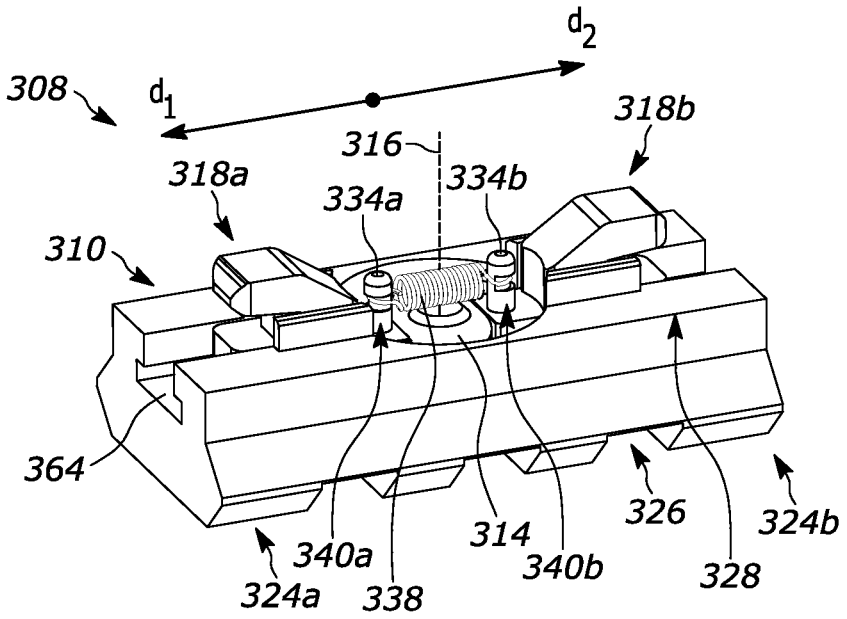
FIG. 3B illustrates a bottom view of a mounting interface having locking mechanisms in an unlocked position, according to one or more examples of the present disclosure.
Figure 3C:
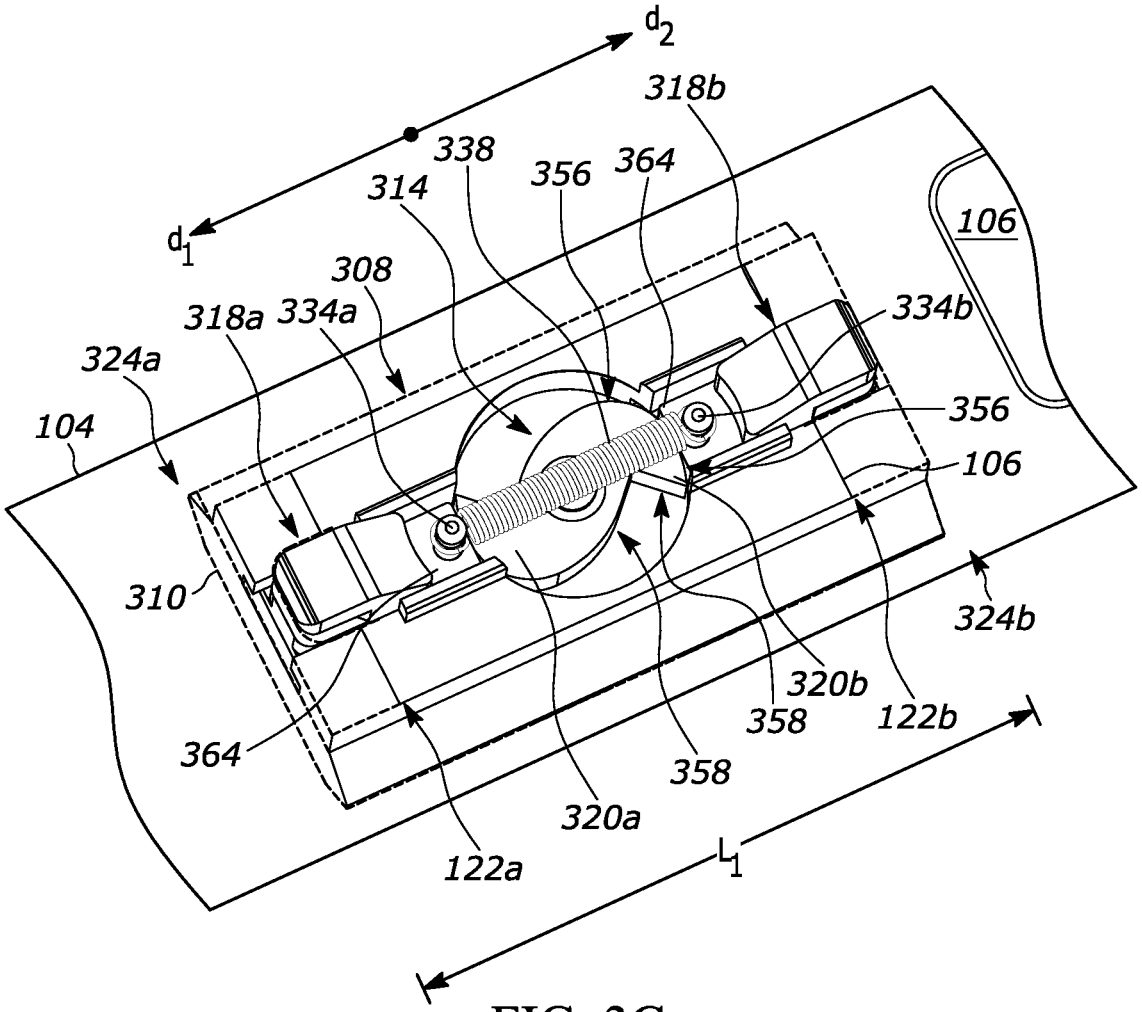
FIG. 3C is a bottom view of a mounting interface having locking mechanisms in a locked position, according to one or more examples of the present disclosure.

As shown in FIGS. 3B-C, the cam 314 is coupled to the body 310. The cam 314 is rotatable about the axis 316 shown in FIG. 3A. In some examples, the axis 316 is substantially perpendicular to the body 310. As referred to herein, "substantially perpendicular to" means an angle between 70 and 100 degrees with respect to the body 310. As shown in FIG. 3A, in some examples, the cam 314 is rotatable via slot 332 of a screw 366 fixedly coupled to the cam 314. For example, the cam 314 is rotatable via rotation of a tool. The head of the tool is received by the slot 332.

Figure 3D:
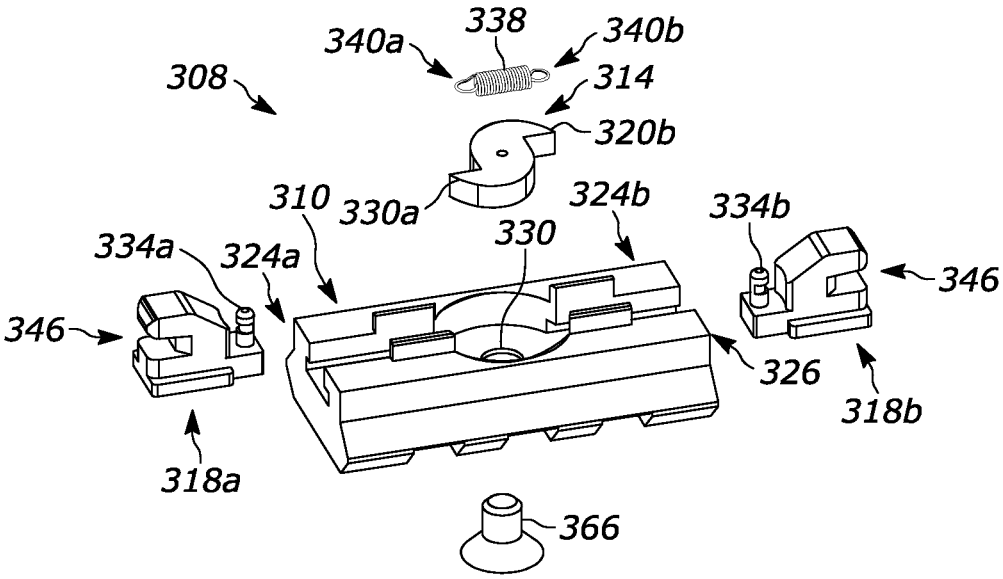
FIG. 3D is an exploded view of a mounting interface, according to one or more examples of the present disclosure.

As shown in FIGS. 3B-D, the first locking mechanism 318*a* and the second locking mechanism 318*b* are movably coupled to the body 310 and positioned on the body 310 to maintain contact with the cam 314. For example, as shown FIGS. 3B-D, the cam 314 includes a first arm 320*a* and a second arm 320*b*, and each locking mechanism 318 is in contact with an arm 320. Examples of the present disclosure also include a cam 314 having more than two arms.

FIG. 3B is a perspective view of the mounting interface 308 with the locking mechanisms 318 in an unlocked position, or a position in which the locking mechanisms 318 are not engaged with or attached to the handguard 104. In response to rotation of the cam 314 about the axis 316 in a first rotational direction, the first locking mechanism 318*a* moves in a first lateral direction d1 along the body 310 and towards a first end 324*a* of the body 310. In some examples, rotating the cam 90 degrees about the axis 316 in the first rotational direction r1 causes the first locking mechanism 318*a* to move from the position shown in FIG. 3B to the position shown in FIG. 3C. FIG. 3C is a bottom view of the mounting interface 308 attached to the handguard 104. In other words, FIG. 3C is a bottom view of the mounting interface 308 with locking mechanisms 318 engaged with ends 122 of one or more openings 106 of the handguard 104. As shown in FIG. 3C, the first locking mechanism 318*a* engages with a first end 122*a* of an opening 106 of the handguard 104 of the gun 102.

Similarly, in response to rotation of the cam 314 about the axis 316 in a first rotational direction, the second locking mechanism 318*b* moves in a second lateral direction d2 opposite to the first lateral direction d1, away from the cam 314, and towards a second end 324*b* of the body 310 opposite to the first end 324*a*. The second locking mechanism 318*b* engages with a second end 122*b* of the opening 106 opposite to the first end 122*a* of the opening 106. In some examples, each of the first direction d1 and the second direction d2 are substantially parallel to the length l1 of the body 310 and substantially perpendicular to the axis 316. In some examples, rotating the cam 314 causes the locking mechanisms 318 to move in the lateral directions d1 and d2 simultaneously.

The locking mechanisms 318 are removable from the first end 122*a* and/or from the second end 122*b* by rotating the cam 314 about the axis 316 in a second rotational direction opposite to the first rotational direction. Each of the locking mechanisms 318 are configured to move from an end 324 of the body 310 in a lateral direction (e.g., d1 or d2) towards the axis 316. In some examples, rotating the cam 314 approximately 90 degrees in the second rotational direction causes the locking mechanisms 318 to disengage from the handguard 104 and moves the locking mechanisms 318 from the position shown in FIG. 3C back to the position shown in FIG. 3B. In some examples, once the locking mechanisms 318*a* and 318*b* have disengaged from the ends 122*a*, 122*b* of the opening 106, as shown in FIG. 3B, the mounting interface 308 is no longer attached to the handguard 104 and can be removed from the handguard 104 without any additional manipulation or tools.

In some examples, the arms 320 each include a curved edge 356 and at least two substantially straight edges 358. As shown in FIG. 3C, in some examples, the cam 314 has a double snail shape. In some examples, the locking mechanisms 318 are configured to move along the curved edges 356 of the arms 320 as they move in the lateral directions d1 and d2 and are configured to contact the straight edges 358 in an unlocked position, as shown in FIG. 3B.

As shown in FIGS. 3A-B, the body 310 includes a first side 326 and a second side 328 opposite to the first side 326. In some examples, the body 310 is one piece. In other examples, the body 310 includes two pieces attached together. In such examples, the first side 326 is a side of a first piece, and the second side 328 is a side of another piece. In some examples, the first piece and the second piece are removable from each other.

As shown in FIGS. 3A and 3D, the first side 326 includes an opening 330 extending through a thickness t1 of the body 310. The second side 328 is coupled to the cam 314 and to the locking mechanisms 318. The opening 330 at least partially overlaps a screw 366 coupled to the cam 314 and/or the cam 314 itself. The cam 314 is coupled to the second side 328 opposite to the first side 326. The screw 366 includes a slot 332 accessible through the opening 330 and configured to receive a head of a tool to cause rotation of the cam 314 in response to rotation of the tool.

Figure 3E:
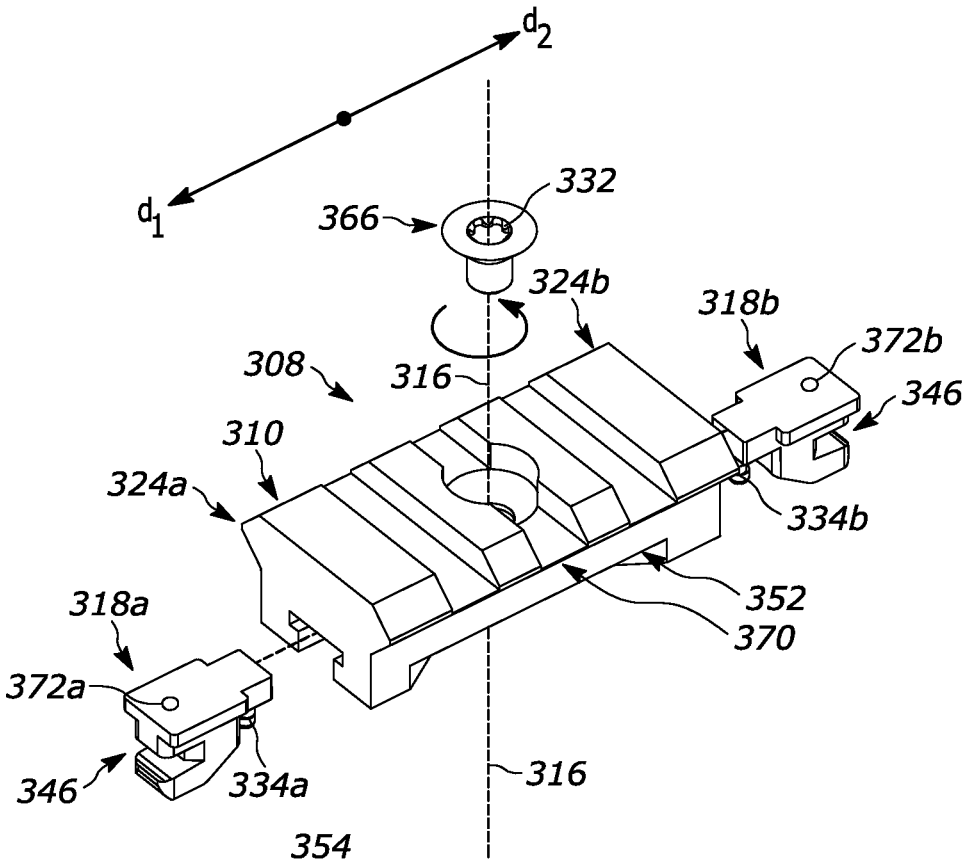
FIG. 3E is another exploded view of a mounting interface, according to one or more examples of the present disclosure.

As shown in FIG. 3A, the body 310 includes at least two additional body openings 342*a*, 342*b* that extend through a thickness t1 of the body 310. Each of the two additional body openings 342*a*, 342*b* is configured to receive a screw 344*a*, 344*b*. In some examples, the two additional body openings 342*a*, 342*b* are located on the body 310 such that they are aligned with an opening of a locking mechanism 318 when the locking mechanism 318 is in the locked position. In other words, the two additional body openings 342*a*, 342*b* are aligned with an opening of the locking mechanism 318 when the locking mechanism is engaged with an end 122 of an opening 106, or the position shown in FIG. 3C. FIG. 3E shows locking mechanism sockets 372*a*, 372*b*. The sockets 372*a*, 372*b* of the locking mechanisms 318 each receive a screw 344*a*, 344*b* simultaneously with one of the additional body openings 342*a*, 342*b*.

As shown in FIG. 3B, each of the first locking mechanism 318*a* and the second locking mechanism 318*b* includes a peg 334. The pegs 334 are each configured to receive opposite ends 340*a*. 340*b* of a spring 338. In some examples, the spring 338 is in equilibrium when the locking mechanisms 318 are in an unlocked position (e.g., the position shown in FIG. 3B). As the cam 314 is rotated and the locking mechanisms 318 move towards the ends 324, the spring 338 is stretched.

In some examples, the spring 338 is a locking spring, and the spring 338 locks when the cam 314 is rotated 180 degrees from the starting position shown in FIG. 3B (e.g., the spring 338 locks when it reaches the extension shown in FIG. 3C). In other words, the spring 338 locks when the locking mechanisms 318 reach the ends 324 of the mounting interface 308 and engage with the ends 122 of the slot(s) 106. As such, when the locking mechanisms 318 reach the ends 324 of the mounting interface 308, the spring 338 does not exert significant force on the locking mechanisms 318 or pull them back towards the center line 316. In some examples, when the cam 314 is rotated to disengage the locking mechanisms 318 from the ends 122 of the opening(s) 106, the spring 338 is unlocked, and the spring 338 pulls the locking mechanisms 318 back towards the center line 316 and towards the spring 338 equilibrium.

FIG. 3D is an exploded view of a mounting interface 308, according to one or more examples of the present disclosure. As shown in FIG. 3D, each of the locking mechanisms 318 includes a slot 346 that is configured to receive an end 122 of the opening 106 of the handguard 104. In some examples, each slot 346 is tapered in a similar manner as the slot 546 of the locking mechanism 518*a* shown in FIG. 6. As such, as the first locking mechanism 318*a* moves in a first direction d1, the end 122*a* of the opening 106 moves down a slanted edge of the slot 346*a*. This helps to prevent accidental release of the locking mechanism 318*a* from the end 122*a*.

FIGS. 4A-D illustrate various views of a mounting interface 408 having one or more levers 450, according to one or more examples of the present disclosure. In some examples, the mounting interface 408 is an example of the mounting interfaces 108 and 208 of FIGS. 1A-2. In some examples, the mounting interface 408 is an example of the mounting interface 308 of FIG. 3A-3C, with an addition of levers 450 and without the screws 344*a*, 344*b*.

Figure 4A:
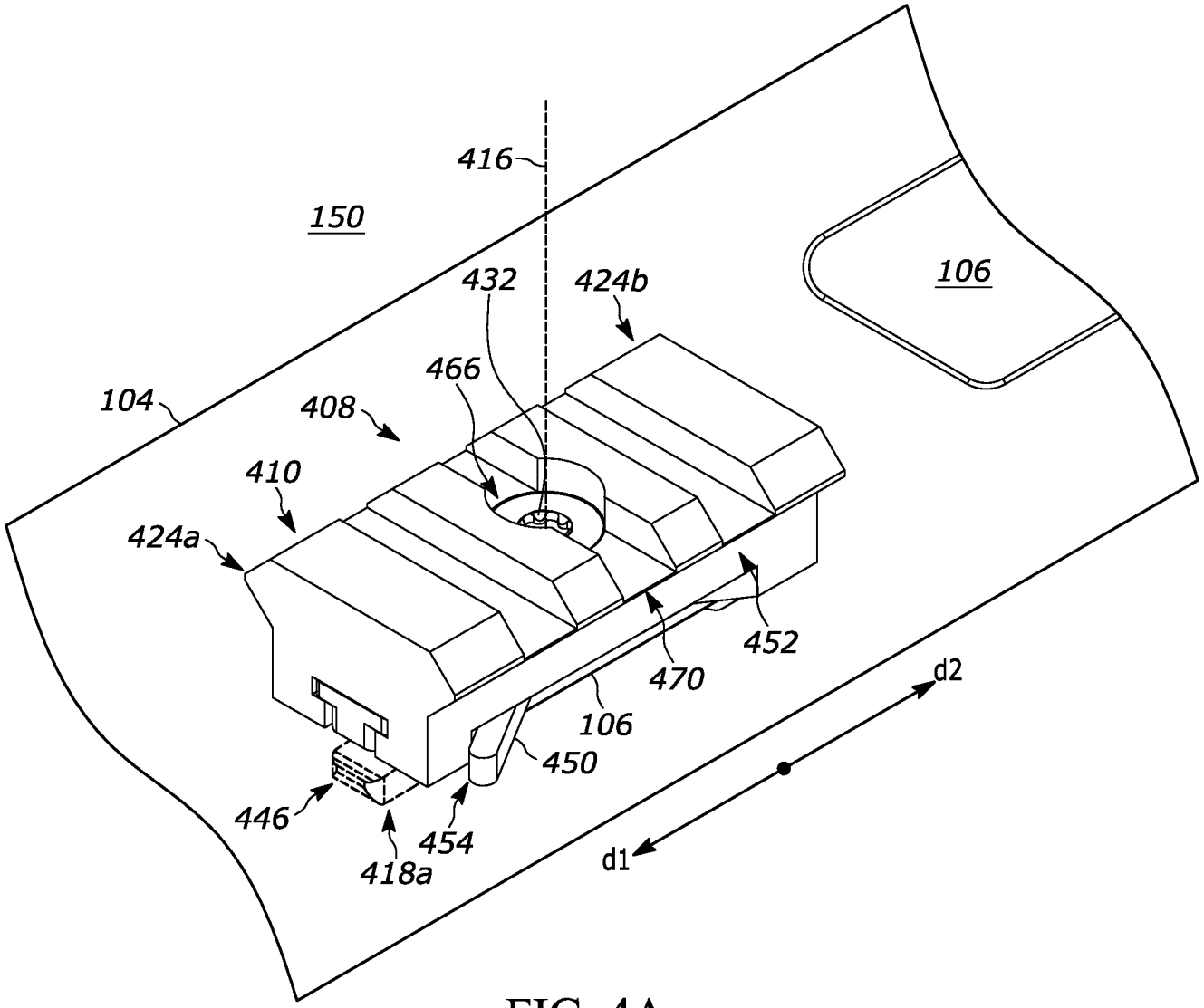
FIG. 4A is a perspective view of a mounting interface having one or more levers, according to one or more examples of the present disclosure.
Figure 4B:
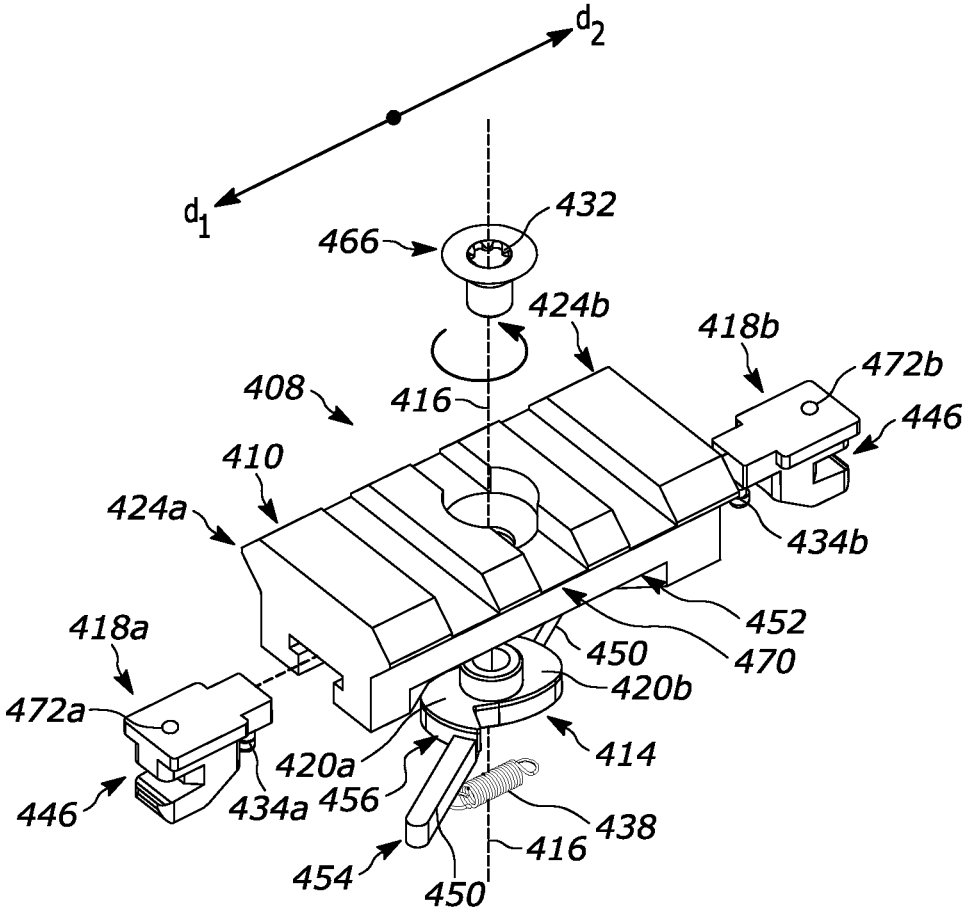
FIG. 4B is an exploded view of a mounting interface having one or more levers, according to one or more examples of the present disclosure.
Figure 4C:
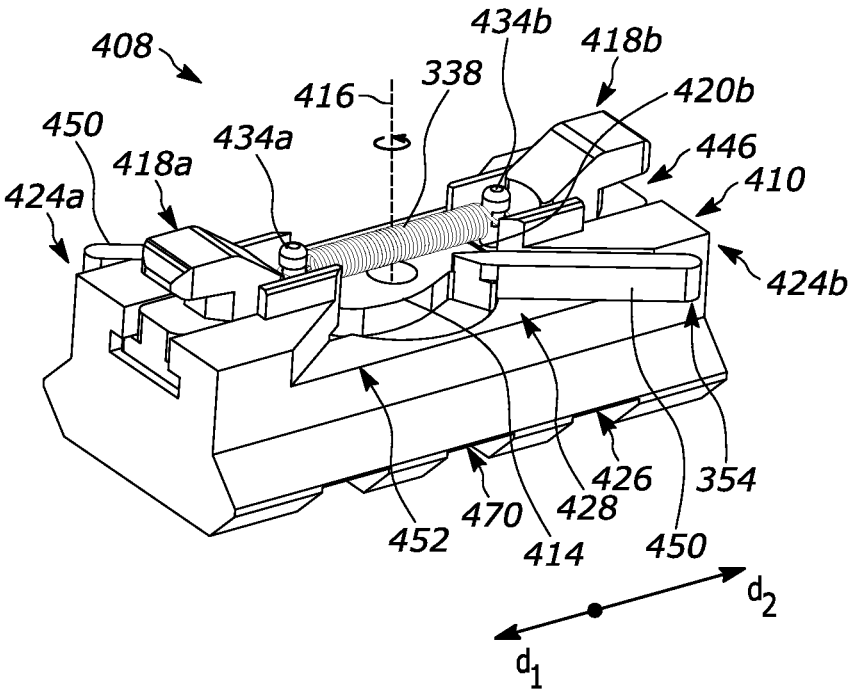
FIG. 4C is a bottom view of a mounting interface having one or more levers and locking mechanisms in an unlocked position, according to one or more examples of the present disclosure.
Figure 4D:
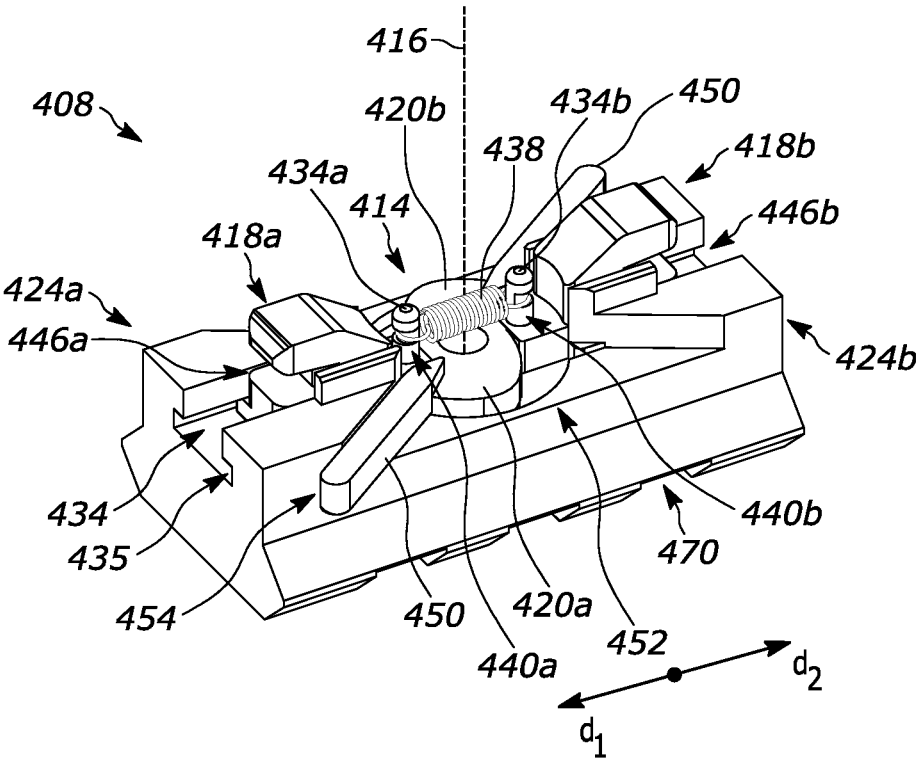
FIG. 4D is a bottom view of a mounting interface having one or more levers and locking mechanisms in a locked position, according to one or more examples of the present disclosure.

As shown in FIG. 4A, for example, the mounting interface 408 includes at least one lever 450 coupled to and extending outward from the cam 414. As shown in FIGS. 4A-E, the mounting interface 408 includes at least two levers 450. However, examples of the present disclosure also include three or more levers 450. As shown in FIG. 4B, in some examples, the levers 450 are fixed to the cam 414. In such examples, moving the levers 450 in a rotational direction causes the cam 414 to rotate in that direction and causes the locking mechanisms 418*a*, 418*b* to move in lateral directions d1 and d2 towards the ends 424*a*, 424*b* of the body 410.

As shown in FIG. 4A, in some examples, when the mounting interface 408 is attached to one or more openings 106 of the handguard 104, the levers 450 are accessible from an exterior 150 of the handguard 104. A distance between the axis 416 and an end 454 of each lever 450 is greater than a distance between the axis 416 and an edge 452 of the body 410. The cam 414 is rotatable about the axis 416 via the lever 450, which moves in a plane substantially parallel to the body 410 and/or to the handguard 104. As such, the cam 414 is rotatable from an exterior 150 of the handguard 104 by moving the levers 450. The levers 450 help to provide the ability to rotate the cam 414 (and thus, move the locking mechanisms 418*a*, 418*b*) even without access to a slot 432 of a component (e.g., a screw 466) of or coupled to the cam 414.

Figure 4E:
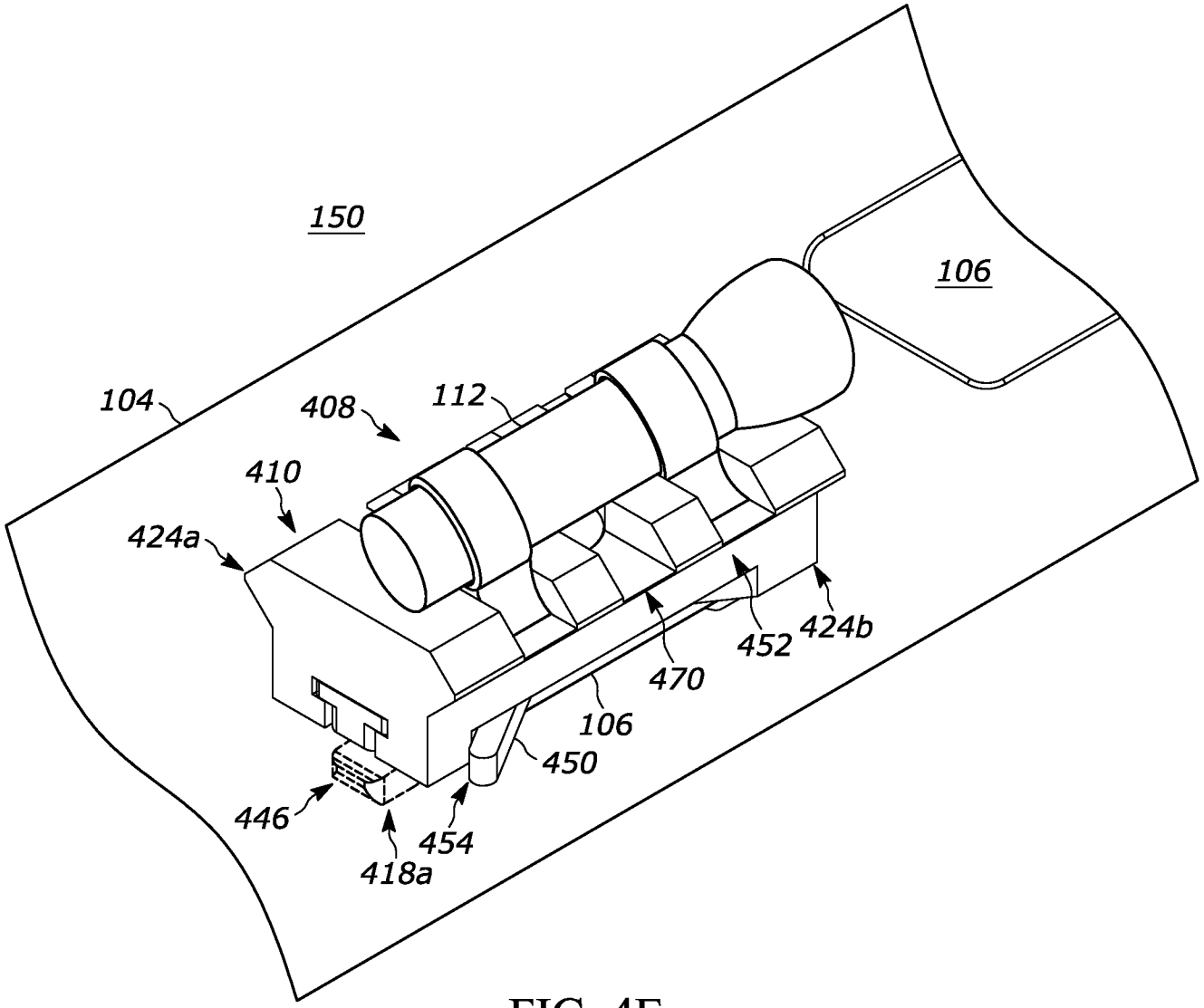
FIG. 4E is a perspective view of a mounting interface having one or more levers and an accessory attached to the mounting interface, according to one or more examples of the present disclosure.

For example, as shown in FIG. 4E, an accessory 412 is coupled to a first side 428 of the mounting interface body 410 in a similar manner in which the accessory 112 is coupled to the mounting interface body 108, as shown in FIG. 1C. In some examples, the accessory 412 partially blocks the screw 466 and/or makes access to it difficult without removing the accessory 412 from the mounting interface 408. However, the cam 414 is rotatable about the axis 316 via the levers 450, even while the accessory 412 is coupled to the first side 428. As such, the levers 450 can help to reduce the need for removal and reattachment of the accessory 412. In such examples, the locking mechanisms 418 are configured to be engaged and/or disengaged from the sides 122*a*, 122*b* of the opening(s) 106 without removing the accessory 412 from the mounting interface 408.

In some examples, each of the levers 450 extend in directions that are parallel to each other. As shown in FIG.

4A, in some examples, each arm 420 of the cam 414 is attached to a lever 450. For example, the lever 450 is attached to a curved edge 456 of a cam arm 420. In some examples, the levers 450 extend in a direction substantially perpendicular to axis 416 and substantially parallel to a plane of the directions d1 and d2.

In some examples, the cam 414 is still configured to rotate about the axis 416 in response to rotation of a screw 466 attached to the cam 414 and visible via an opening 430 of the body 410. As such, even with the levers 450, the mounting interface 408 is configured to be removed from and/or attached to ends 122 of opening(s) 106 via direct rotation of the cam 414 through the screw 466.

In some examples, the second side 428 of the body 410 includes a recess 434. The gear 414 and the locking mechanisms 434 are positioned within the recess 434 and move within the recess 434. For example, a locking mechanism 418 includes a portion configured to mate with a groove 435 in the body 410, and the locking mechanism 418 moves within the groove 435.

Figure 5A:
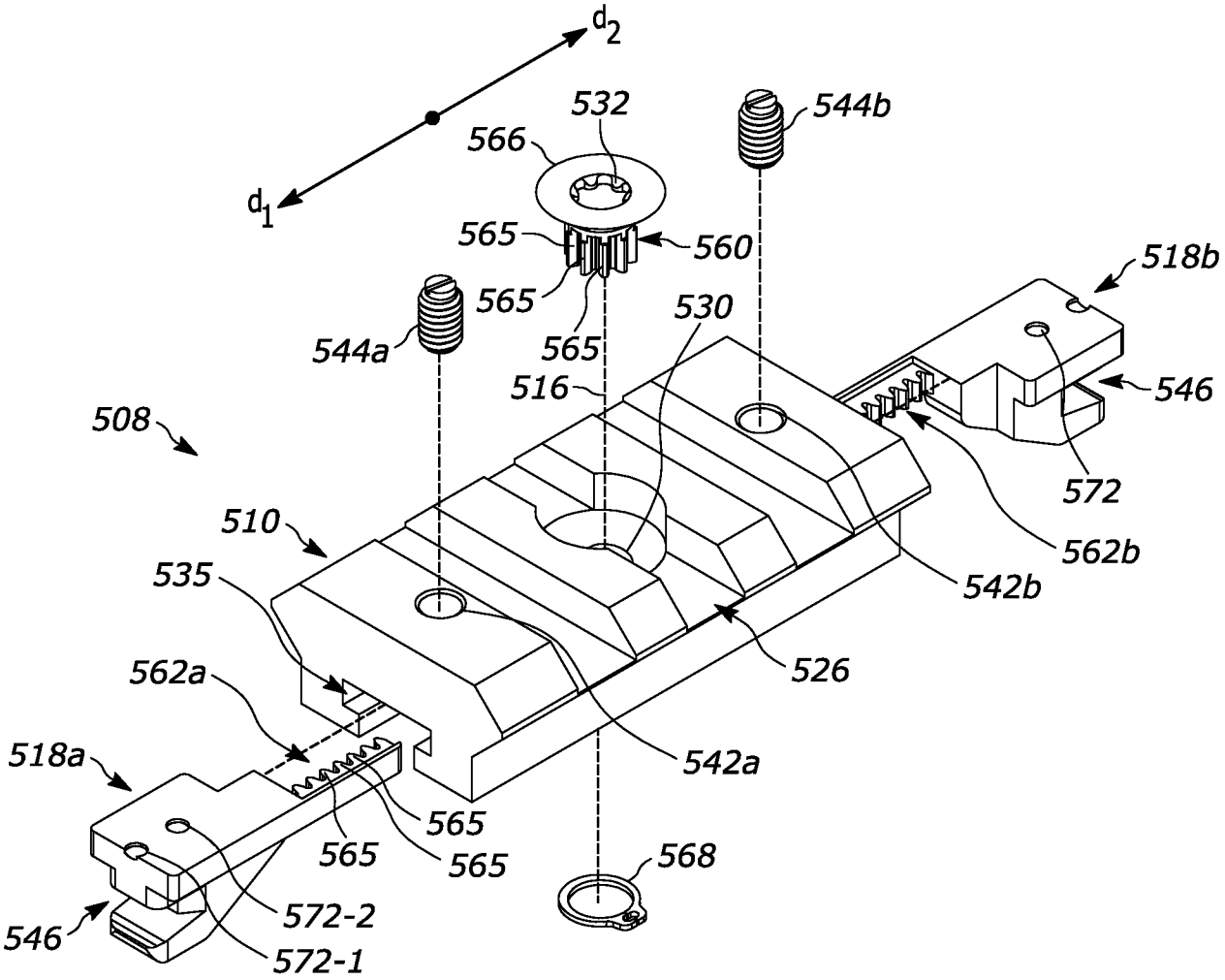
FIG. 5A is an exploded view of a mounting interface having one or more gears and locking mechanisms in an unlocked position, according to one or more examples of the present disclosure.
Figure 5B:
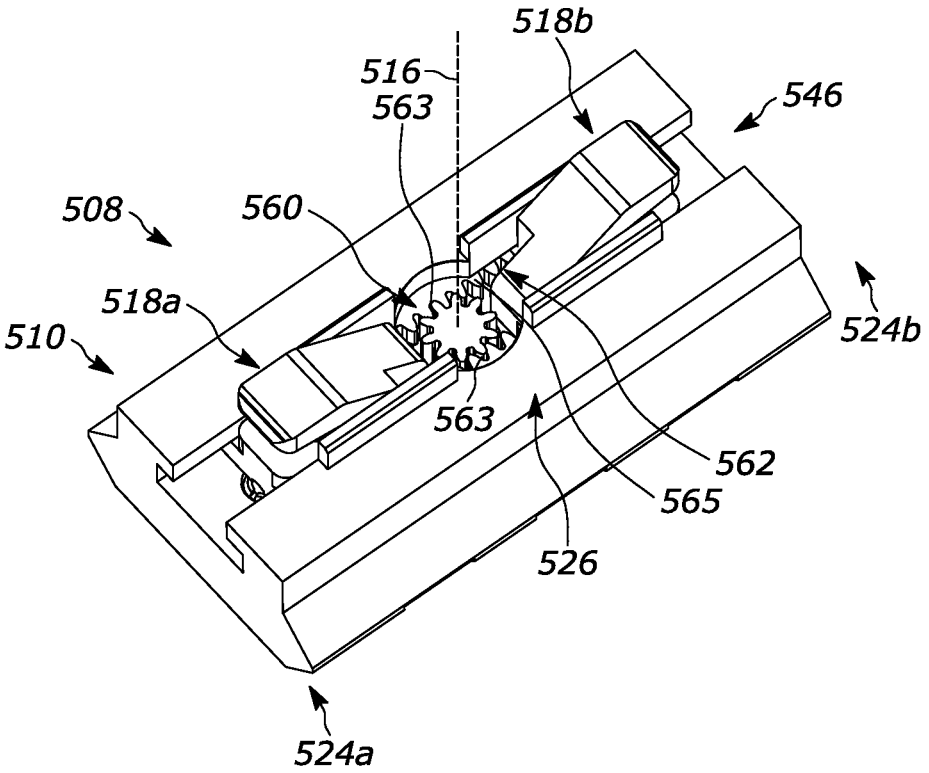
FIG. 5B is a bottom view of a mounting interface having one or more gears and locking mechanisms in an unlocked position, according to one or more examples of the present disclosure.
Figure 5C:
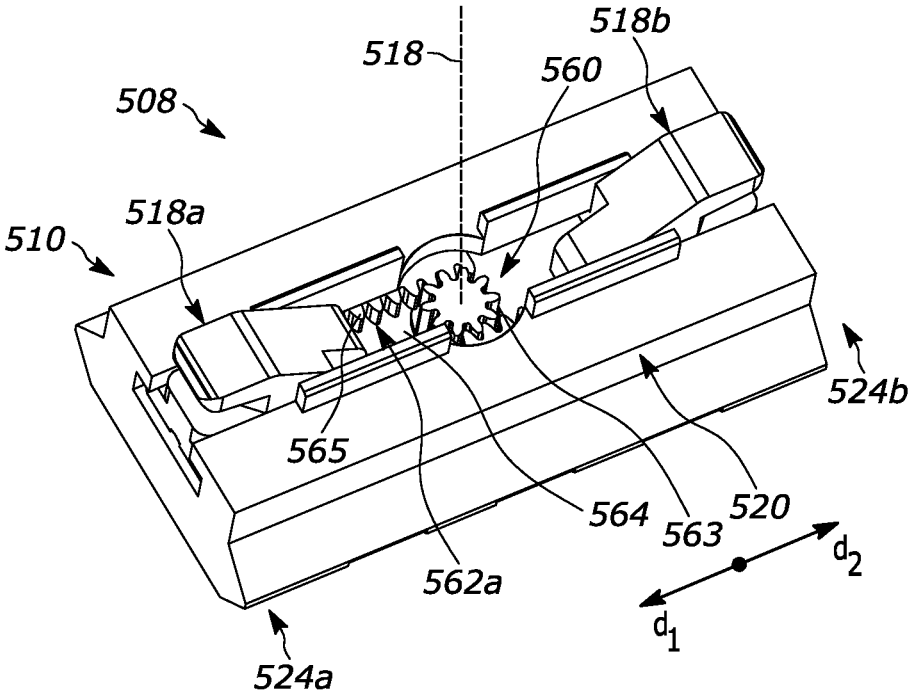
FIG. 5C is a bottom view of a mounting interface having one or more gears and locking mechanisms in a locked position, according to one or more examples of the present disclosure.

FIGS. 5A-C illustrate views of a mounting interface 508 according to an example of the present disclosure. The mounting interface 508 includes a body 510, a pinion gear 560 rotatable about an axis 516, a first rack gear 562*a*, a first locking mechanism 518*a*, a second rack gear 562*b*, a second locking mechanism 518*b*, and one or more screws 544*a* and 544*b*. In some examples, the mounting interface 508 is an example of the mounting interfaces 108 and 208 of FIGS. 1A-2.

FIG. 5A is an exploded view of a mounting interface 508 having one or more gears 562*a*, 562*b*, and 560 and locking mechanisms 518 in an unlocked position, according to one or more examples of the present disclosure. In some examples, the gears 562*a*, 562*b* are rack gears that are each fixedly coupled to a locking mechanism 518*a*, 518*b*. As shown in FIG. 5A, in some examples, each gear 562*a*, 562*b* extends in a direction d1 or d2 that is substantially perpendicular to the axis of rotation 516. In some examples, the gear 560 is a pinion gear that is part of a rack and pinion system with the rack gears 562.

As shown in FIG. 5A, in some examples, the body 510 includes a first side 526 opposite to the second side 528 shown in FIGS. 5B and 5C. The first side 526 includes an opening 530 that receives the pinion gear 560 and through which a screw 566 or other component coupled to the pinion gear 560 is visible from the first side 526. In some examples, the screw 566 includes a slot 532 that is accessible through the opening 530 and shaped to receive a head of a tool to cause rotation of the pinion gear 560 in response to rotation of the tool. In some examples, the mounting interface 508 includes levers (e.g., levers similar to the levers 450 of FIGS. 4A-E) configured to cause rotation of the pinion gear 560, in addition to and/or in alternative to rotation of the pinion gear 560 via the slot 532. Although not shown in the Figures, in some examples, a mounting interface includes a body 510 without the opening 530, since levers would allow the user to move the locking mechanisms 518 without accessing the pinion gear 560 directly.

As shown in FIG. 5B, in some examples, the pinion gear 560 is coupled to the body 510 and rotatable about an axis 516 substantially perpendicular to the body 510. In some examples, the second side 528 of the body 510 includes a recess 534 in which the pinion gear 560, first rack gear 562*a*, and second rack gear 562*b* are positioned. The rack gears 562 and locking mechanisms 518 move within the recess 534 and along the body 510. The pinion gear 560 rotates independently from the body 510 and within the recess 534. In some examples, the second side 528 of the body 510 includes a number of grooves 535, and the rack gears are 562 are configured to slide within the grooves 535 in response to rotation of the pinion gear 560.

In some examples, each of the first rack gear 562*a* and the second rack gear 562*b* are positioned to engage with the pinion gear 560. For example, the pinion gear 560 includes a number of components configured to mate with components of the rack gears 562*a*, 562*b*. For example, the pinion gear 560 includes a number of teeth 563, and each rack gear 562*a*, 562*b* also includes a number of teeth 565. As shown in FIG. 5A, in some examples, the mounting interface 508 includes a ring 568 configured to fit around a circumference of the pinion gear 560 and to secure the pinion gear 560 to the body 510 while permitting rotation of the pinion gear 560 with respect to the body 510. In some examples, the ring 568 includes a split ring or a circlip, for example.

FIG. 5B is a bottom view of a mounting interface 508 having one or more gears 562*a*, 562*b* and locking mechanisms 518*a*, 518*b* in an unlocked position, according to one or more examples of the present disclosure. FIG. 5C is a bottom view of a mounting interface 508 having one or more gears 562*a*, 562*b* and locking mechanisms 518*a*, 518*b* in a locked position, according to one or more examples of the present disclosure.

The first rack gear 562*a*, in some examples, is configured to, in response to rotation of the pinion gear 560, move laterally in a first direction d1 towards a first end 524*a* of the body 510. For example, one or more pinion gear teeth 563 are in contact with one or more rack gear teeth 565. When the pinion gear 560 is rotated, the pinion gear teeth 563 move in that rotational direction, thus pushing the rack gear 562*a* in at least one of a lateral direction d1 or d2. Likewise, the second rack gear 562*b*, in response to rotation of the pinion gear 560 about the axis 516, move laterally in a second direction d2 opposite the first direction d1 and towards a second end 524*b* opposite the first end 524*a* of the body 510. In some examples, motion of the first rack gear 562*a* and the second rack gear 562*b* occurs simultaneously with rotation of the pinion gear 560.

The first locking mechanism 518*a* is coupled to the first rack gear 562*a* and configured to engage with a first end of an opening 106 of a handguard 104 (e.g., end 122*a*). In some examples, the second locking mechanism 518*b* is coupled to the second rack gear 562*b* and configured to engage with a second end of the opening 106 opposite to the first end of the opening 106 (e.g., end 122*b*). In some examples, the second locking mechanism 518*b* is configured to engage with an end of a different opening 106 than the first locking mechanism 518*a*, as shown in FIG. 2.

As shown in FIG. 5A, the mounting interface 508, in some examples, includes a number of additional screws 544*a*, 544*b*. In some examples, the additional screws 544*a*, 544*b* are received by additional openings 542*a*, 542*b* in the body 510. The additional openings 542*a*. 542*b* are substantially aligned with sockets 572 in the locking mechanisms 518 when the locking mechanisms 518 are engaged with ends 122 of the opening(s). In some examples, the openings 572 receive the screws 544*a*, 544*b* simultaneously with the additional body openings 542*a*, 542*b* to help provide additional security of the mounting interface 508 attachment to the handguard 104. In some examples, the screws 544*a*, 544*b* are inserted into and removed from the openings 572 via rotation of the cam 514. For example, the screws 544*a*, 544*b* include ball-bearing springs. As shown in FIG. 5A, in some examples, each locking mechanism 518 includes at least two sockets 572 to provide multiple options for attachment positions. For example, a first locking mechanism socket 572-1 receives the screw 544*a* in a first attachment position to secure the locking mechanism 518*a* to an end of an opening (e.g., end 122*a*). In some examples, the cam 514 is rotated to move the locking mechanism 518*a* in a direction d1. The screw 544*a* is pushed out of the first opening 572-1 and is eventually received by another opening 572-2. This allows the end 122*a* of the opening 106 to be received deeper within the slot 546 of the locking mechanism 518*a* and can provide a more secure attachment.

In some examples, the screws 544*a*, 544*b* each include spring-loaded ball bearings within them. In some examples, the screws 544*a*, 544*b* move in and out of the sockets 572 in the locking mechanisms 518 as the locking mechanisms 518 move. For example, in an unlocked position shown in FIG. 5B, the screw 544*a* is received by a first locking mechanism socket 572-1. As the pinion gear 560 is rotated and the locking mechanism 518*a* moves in the first direction d1, the screw 544*a* moves up and out of the opening 572-2 and eventually settles into a second socket 572-2 to secure the locking mechanism 518*a* in the locked position, as shown in FIG. 5C.

Figure 6:
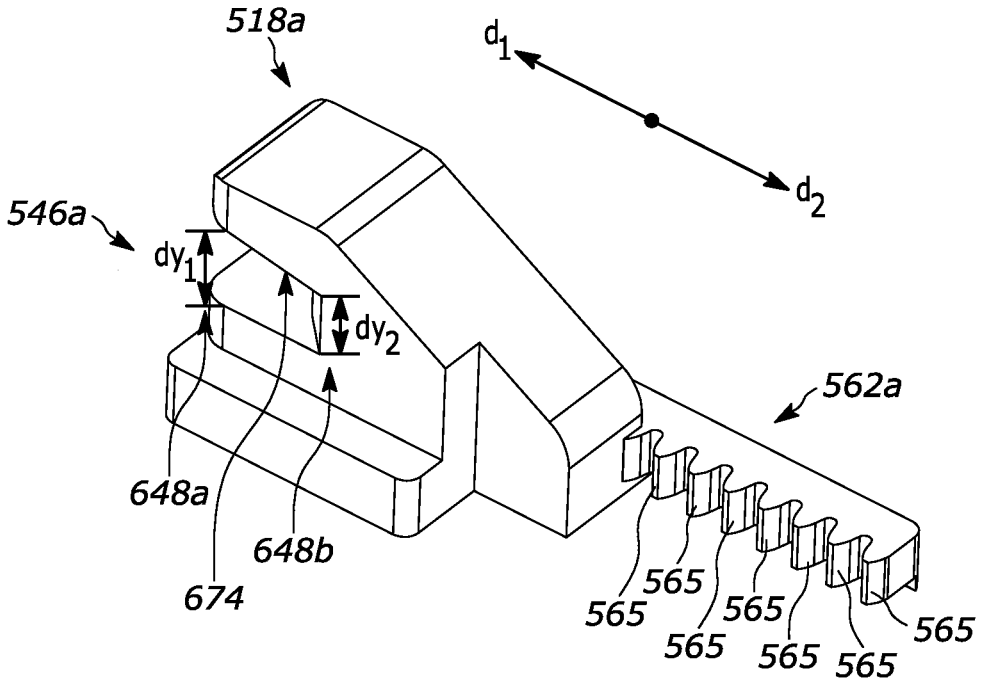
FIG. 6 is a perspective view of a rack gear and a locking mechanism, according to one or more examples of the present disclosure.

FIG. 6 is a perspective view of a rack gear 562*a* and a locking mechanism 518*a*, according to one or more examples of the present disclosure. As shown in FIG. 6, in some examples, each slot 546 of the locking mechanisms 518 is tapered. For example, each slot 546 has a first height dy1 at a first slot end 648*a* and a second height dy2 at a second slot end 648*b* opposite to the first slot end 648*a*. The first height dy1 is greater than the second height dy2. In some examples, the first slot end 648*a* is located further from the rotational axis 516 than the second slot end 648*b* is. As such, the slot 546*a* slopes upward in the direction d1 from the cam 514 to the first slot end 122*a*.

In the above description, certain terms may be used such as "up," "down," "upper," "lower," "horizontal," "vertical," "left," "right," "over," "under" and the like. These terms are used, where applicable, to provide some clarity of description when dealing with relative relationships. But, these terms are not intended to imply absolute relationships, positions, and/or orientations. For example, with respect to an object, an "upper" surface can become a "lower" surface simply by turning the object over. Nevertheless, it is still the same object. Further, the terms "including," "comprising," "having," and variations thereof mean "including but not limited to" unless expressly specified otherwise. An enumerated listing of items does not imply that any or all of the items are mutually exclusive and/or mutually inclusive, unless expressly specified otherwise. The terms "a," "an," and "the" also refer to "one or more" unless expressly specified otherwise. Further, the term "plurality" can be defined as "at least two." Moreover, unless otherwise noted, as defined herein a plurality of particular features does not necessarily mean every particular feature of an entire set or class of the particular features.

Additionally, instances in this specification where one element is "coupled" to another element can include direct and indirect coupling. Direct coupling can be defined as one element coupled to and in some contact with another element. Indirect coupling can be defined as coupling between two elements not in direct contact with each other, but having one or more additional elements between the coupled elements. Further, as used herein, securing one element to another element can include direct securing and indirect securing. Additionally, as used herein, "adjacent" does not necessarily denote contact. For example, one element can be adjacent to another element without being in contact with that element.

As used herein, the phrase "at least one of", when used with a list of items, means different combinations of one or more of the listed items may be used and only one of the items in the list may be needed. The item may be a particular object, thing, or category. In other words, "at least one of" means any combination of items or number of items may be used from the list, but not all of the items in the list may be required. For example, "at least one of item A, item B, and item C" may mean item A; item A and item B; item B; item A, item B, and item C; or item B and item C. In some cases, "at least one of item A, item B, and item C" may mean, for example, without limitation, two of item A, one of item B, and ten of item C; four of item B and seven of item C; or some other suitable combination.

Unless otherwise indicated, the terms "first," "second," etc. are used herein merely as labels, and are not intended to impose ordinal, positional, or hierarchical requirements on the items to which these terms refer. Moreover, reference to, e.g., a "second" item does not require or preclude the existence of, e.g., a "first" or lower-numbered item, and/or, e.g., a "third" or higher-numbered item.

As used herein, a system, apparatus, structure, article, element, component, or hardware "configured to" perform a specified function is indeed capable of performing the specified function without any alteration, rather than merely having potential to perform the specified function after further modification. In other words, the system, apparatus, structure, article, element, component, or hardware "configured to" perform a specified function is specifically selected, created, implemented, utilized, programmed, and/or designed for the purpose of performing the specified function. As used herein, "configured to" denotes existing characteristics of a system, apparatus, structure, article, element, component, or hardware which enable the system, apparatus, structure, article, element, component, or hardware to perform the specified function without further modification. For purposes of this disclosure, a system, apparatus, structure, article, element, component, or hardware described as being "configured to" perform a particular function may additionally or alternatively be described as being "adapted to" and/or as being "operative to" perform that function.

The schematic flow chart diagrams included herein are generally set forth as logical flow chart diagrams. As such, the depicted order and labeled steps are indicative of one example of the presented method. Other steps and methods may be conceived that are equivalent in function, logic, or effect to one or more steps, or portions thereof, of the illustrated method. Additionally, the format and symbols employed are provided to explain the logical steps of the method and are understood not to limit the scope of the method. Although various arrow types and line types may be employed in the flow chart diagrams, they are understood not to limit the scope of the corresponding method. Indeed, some arrows or other connectors may be used to indicate only the logical flow of the method. For instance, an arrow may indicate a waiting or monitoring period of unspecified duration between enumerated steps of the depicted method. Additionally, the order in which a particular method occurs may or may not strictly adhere to the order of the corresponding steps shown.

The present subject matter may be embodied in other specific forms without departing from its spirit or essential characteristics. The described examples are to be considered in all respects only as illustrative and not restrictive. All changes which come within the meaning and range of equivalency of the claims are to be embraced within their scope.

What is claimed is:

1. A mounting interface, comprising:

a body;

a cam coupled to the body and rotatable about an axis;

a first locking mechanism positioned in contact with a first arm of the cam and configured to, in response to rotation of the cam in a first rotational direction:

move in a first lateral direction towards a first end of the body; and engage with a first end of a first opening of a handguard of a gun; and a second locking mechanism positioned in contact with a second arm of the cam and configured to, in response to rotation of the cam in the first rotational direction:

move in a second lateral direction opposite the first direction and towards a second end of the body opposite the first end; and engage with at least one of a second end of the first opening opposite to the first end of the opening and an end of a second opening of the handguard.

2. The mounting interface of claim 1, wherein the body comprises:

a first side comprising an opening; and a second side coupled to the cam and to the at least two locking mechanisms, wherein the opening at least partially overlaps the cam.

3. The mounting interface of claim 2, wherein the cam is coupled to a component comprising a slot accessible through the opening and configured to receive a head of a tool to cause rotation of the cam in response to rotation of the tool.

4. The mounting interface of claim 1, each of the first locking mechanism and second locking mechanism comprising a peg configured to receive an end of a spring.

5. The mounting interface of claim 1, wherein:

the body comprises at least two body openings; and each of the first locking mechanism and the second locking mechanism comprises a socket.

6. The mounting interface of claim 5, wherein at least one of the at least two body openings is configured to receive a screw simultaneously with the socket.

7. The mounting interface of claim 1, wherein each of the first direction and the second direction is substantially perpendicular to the axis.

8. The mounting interface of claim 1, wherein:

the first locking mechanism is configured to, in response to rotation of the cam in a second rotational direction opposite to the first rotational direction, move from the first end of the body in the second lateral direction towards the axis; and the second locking mechanism is configured to, in response to rotation of the cam in the second rotational direction, move from the second end of the body in the first lateral direction towards the axis.

9. The mounting interface of claim 1, at least one of the first locking mechanism and the second locking mechanism comprising a slot configured to receive at least one of the first end of the first opening, the second end of the first opening, or the end of the second opening.

10. The mounting interface of claim 9, the slot having a first height at a first slot end and a second height at a second slot end opposite to the first slot end, wherein:

the first height is greater than the second height; and a distance between the first slot end and the cam is greater than a distance between the second slot end and the cam.

11. The mounting interface of claim 1, further comprising at least one lever coupled to and extending outward from the cam, wherein a distance between the axis and an end of the at least one lever is greater than a distance between the axis and an edge of the body and the cam is rotatable via the lever.

12. A system, comprising:

a body;

a gun accessory coupled to a first side of the body;

a cam coupled to a second side of the body opposite to the first side of the body and rotatable about an axis;

a first locking mechanism positioned in contact with a first arm of the cam and configured to, in response to rotation of the cam in a first rotational direction:

move in a first lateral direction towards a first end of the body; and engage with a first end a first opening of a handguard of a gun; and a second locking mechanism positioned in contact with a second arm of the cam and configured to, in response to rotation of the cam in the first rotational direction:

move in a second lateral direction opposite the first direction and towards a second end of the body opposite the first end; and engage with at least one of an end of a second opening of the handguard and a second end of the first opening opposite to the first end of the first opening.

13. The system of claim 12, wherein the accessory comprises at least one of: a sight, a light, a laser, a foregrip, a bipod, a sling mount, a rail cover, and/or any combination thereof.

14. The system of claim 12, further comprising at least one lever coupled to and extending outward from the cam, wherein:

a distance between the axis and an end of the at least one lever is greater than a distance between the axis and an edge of the body; and the cam is rotatable via the lever while the accessory is coupled to the first side.

15. The system of claim 12, wherein the body comprises at least one of a modular lock rail or a picatinny rail.

16. The system of claim 12, wherein the first arm comprises a curved edge and at least two substantially straight edges.

17. The system of claim 16, wherein the first locking mechanism is configured to move along the curved edge while moving in the first lateral direction.

* * * * *